US012669119B2

(12) United States Patent
Hall, Jr. et al.

(10) Patent No.: US 12,669,119 B2
(45) Date of Patent: Jun. 30, 2026

(54) INDEPENDENT LUBE SYSTEMS FOR RECIPROCATING PUMP

(71) Applicant: GD Energy Products, LLC, Tulsa, OK (US)

(72) Inventors: Randall Turner Hall, Jr., Claremore, OK (US); Timo Waldhoer, Tahlequah, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/918,501

(22) Filed: Oct. 17, 2024

(65) Prior Publication Data

US 2026/0110297 A1 Apr. 23, 2026

(51) Int. Cl.

| | |
|---|---|
| ***F04B 53/18*** | (2006.01) |
| ***E21B 43/26*** | (2006.01) |
| ***F04B 9/02*** | (2006.01) |
| ***F04B 53/00*** | (2006.01) |

(52) U.S. Cl.

CPC ..... *F04B 53/18* (2013.01); *E21B 43/2607* (2020.05); *F04B 9/02* (2013.01); *F04B 53/006* (2013.01)

(58) Field of Classification Search

CPC ..... F04B 53/18; F01M 2001/123

See application file for complete search history.

(56) References Cited

U.S. PATENT DOCUMENTS

| | | | | |
|---|---|---|---|---|
| 5,245,970 | A | 9/1993 | Iwaszkiewicz et al. | |
| 9,127,577 | B2 | 9/2015 | Donald | |
| 10,246,984 | B2 | 4/2019 | Payne et al. | |
| 10,352,321 | B2 | 7/2019 | Byrne et al. | |
| 10,851,638 | B2 | 12/2020 | Payne et al. | |
| 10,859,203 | B1 * | 12/2020 | Cui | F16N 7/40 |
| 11,408,267 | B2 | 8/2022 | Payne et al. | |
| 11,421,682 | B2 | 8/2022 | Byrne et al. | |
| 11,635,068 | B2 * | 4/2023 | Foster | F04B 15/02 417/313 |
| 11,767,748 | B2 | 9/2023 | Payne et al. | |
| 11,795,799 | B2 | 10/2023 | Wilson | |
| 2016/0177945 | A1 * | 6/2016 | Byrne | F04B 1/0404 184/6 |
| 2021/0148349 | A1 * | 5/2021 | Nowell | F04B 53/007 |
| 2022/0389916 | A1 * | 12/2022 | Keith | F04B 15/02 |

FOREIGN PATENT DOCUMENTS

| | | | |
|---|---|---|---|
| CN | 205447206 | U | 8/2016 |

* cited by examiner

*Primary Examiner* — Thomas E Lazo

(74) *Attorney, Agent, or Firm* — Edell, Shapiro & Finnan, LLC

(57) ABSTRACT

According to one aspect, a power end of a high pressure reciprocating pump includes a first area and a second area. The first area includes at least a first component, and the second area includes at least a second component. The power end of the pump also includes a first lube arrangement configured to provide a first lube to the first area, and a second lube arrangement configured to provide a second lube to the second area. In one embodiment, the first lube has a higher viscosity than the second lube.

20 Claims, 17 Drawing Sheets

INDEPENDENT LUBE SYSTEMS FOR RECIPROCATING PUMP

FIELD OF INVENTION

The present invention relates to the field of high pressure reciprocating pumps, such as pumps for fracking and drilling, and, in particular, to enabling a power end of a reciprocating pump to have independent lube systems.

BACKGROUND

High pressure reciprocating pumps are often used to deliver high pressure fluids during earth drilling operations. Generally, a reciprocating pump includes a power end and a fluid end. The power end may generate forces sufficient to cause the fluid end to deliver high pressure fluids to earth drilling operations, i.e., hydraulic fracking operations. The power end is typically lubricated by a single lube system to enable a gearbox of the power end to perform at a desired level. A lubricant or lube specified for use in the power end typically contains additives and has a relatively high viscosity. While a lube that contains additives such as extreme pressure (EP) additives and has a relatively high viscosity may facilitate the efficient and desired performance of a gearbox of a power end, the lube may not facilitate the efficient and desired performance of other components of the power end.

SUMMARY

The present application relates to techniques for providing multiple independent lubrication or lube systems associated with a power end of a high pressure reciprocating pump such as a frac pump. Specifically, providing a plurality of lube systems in a power end and power train assembly of a reciprocating pump enables suitable lubes to be provided for different components of the reciprocating pump and, as a result, the efficiency with which the components may operate, the performance of the components, and/or the lifetime of the components may be enhanced.

According to one aspect, a power end of a high pressure reciprocating pump includes a first area and a second area. The first area includes at least a first component and the second area includes at least a second component. The power end also includes a first lube arrangement configured to provide a first lube to the first area, and a second lube arrangement configured to provide a second lube to the second area. In at least some embodiments, the first lube has a higher viscosity than the second lube. Additionally or alternatively, the power end may include a gearbox and a crankcase, and the first area may be in the gearbox while the second area is in the crankcase.

In accordance with another aspect, a pump includes a fluid end and a power end that is coupled to the fluid end and configured to provide pumping power to the fluid end. The power end includes a plurality of independent lube systems including a first lube system and a second lube system. The first lube system provides lube to a first area and the second lube system provides lube to a second area. The first lube system includes a first lube contained in the first area and the second lube system includes a second lube contained in the second area.

In accordance with still another aspect, an assembly for use with a pump includes a first lube system and a second lube system. The first lube system includes a first area and a first lube pump arranged to pump a first lube into the first area. The second lube system includes a second area and a second lube pump arranged to pump a second lube into the second area. The second lube system is isolated from the first lube system, and the first lube has at least one characteristic that differs from the second lube. In one embodiment, the pump is a frac pump.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the disclosure, but just as examples. The drawings comprise the following figures.

Like reference numerals have been used to identify like elements throughout this disclosure.

DETAILED DESCRIPTION

Figure 1:
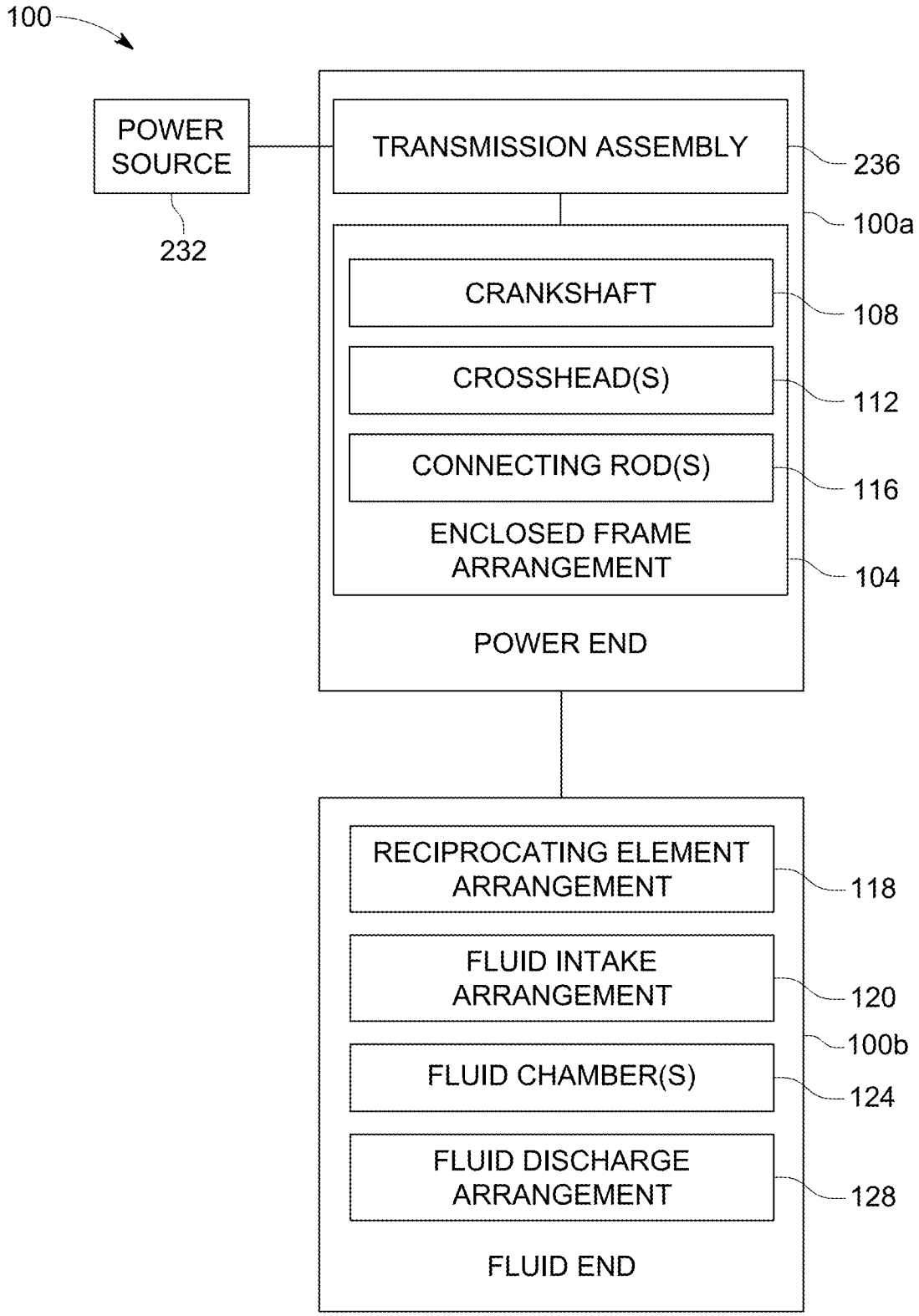
FIG. 1 (PRIOR ART)
FIG. 1 is a diagrammatic representation of a high pressure reciprocating pump.

The following description is not to be taken in a limiting sense but is given solely for the purpose of describing the broad principles of the disclosure. Embodiments of the disclosure will be described by way of example, with reference to the above-mentioned drawings showing elements and results according to the present disclosure.

A power end of a high pressure reciprocating pump, e.g., a frac pump, is generally lubricated using a single lubrication or lube system. The power end often includes a crankcase and gearbox assembly, insofar as the term "crankcase" is used herein to generally denote the main housing of the power end, which generally extends around and houses or encapsulates the crankshaft and other components, including but not limited to, one or more crosshead assemblies and associated pony rods, portions of pinon shafts, and other such components. Meanwhile, the gearbox assembly may take various forms and may sometimes be provided separate from the crankcase. Currently, all of the internal components of a power end, including components in the crankcase and components in the gearbox assembly, are lubricated using the same lubricant or lube. However, lube that is most efficient for a gearbox of a power end typically does not have properties that facilitate the performance and/or enhance the lifetime of other components of the power end. For example, lube that allows a gearbox of a power end to operate efficiently typically contains extreme pressure (EP) additives and has a relatively high viscosity. Lube that contains EP additives and has a relatively high viscosity may have a detrimental effect on other components of a power end, such as components in a crankcase.

Generally, the present disclosure is directed to a power end assembly which supports a plurality of independent lube systems. The ability to support independent lube systems in a power end, such that the lube systems are separate and not in fluid communication with each other, enables lubes to be specifically selected with respect to particular components in the power end. Then, the particular components may be lubricated with lubes that have properties which enhance the performance of and/or lifetime of the particular components. That is, lube conditions for multiple lube systems may differ, and may be selected based upon the particular components the lube systems are to lubricate. The use of independent or isolated lube systems improves lubrication performance of a power end and increases the reliability of the power end. Components of a power end may be separated using mechanical structures, such as seals, into one or more isolated areas, as for example a first area and a second area, such that one lube may be used in the first area and a different lube may be used in the second area. For example, a lube system used to provide a first lube to components (e.g., gears) in a gearbox of a power end may be separate from a lube system used to provide a second, or different, lube to components (e.g., a crankshaft) located within a crankcase of the same power end. By isolating lube systems using one or more seals, components may be lubricated using different lube types, e.g., different oils, and cross-contamination between the different lubes may be substantially avoided.

Referring initially to FIG. 1, a prior art reciprocating pump will be described. A reciprocating pump 100, which may be a frac pump, includes a power end 100*a* and a fluid end 100*b*. Power end 100*a* is configured to generate pumping power, and fluid end 100*b* is configured to deliver a fluid as power end 100*a* generates the pumping power. Power end 100*a* includes an enclosed frame arrangement 104 that includes a crankshaft 108, one or more crossheads 112, and one or more connecting rods 116. Enclosed frame arrangement 104 may generally be a housing such as a crankcase. At a high-level, power end 100*a* receives rotational energy via a driveline or drive shaft and uses this rotational energy to drive, e.g., rotate, crankshaft 108 which, in turn, reciprocating moves the one or more connecting rods 116 and creates linear movement within crossheads 112 (e.g., causing pony rods (not shown) to reciprocate linearly within crossheads 112).

Fluid end 100*b* includes a reciprocating element arrangement 118 that includes one or more reciprocating elements such as plungers or pistons, a fluid intake arrangement 120, at least one fluid chamber 124, and a fluid discharge arrangement 128. Fluid enters into fluid end at fluid intake arrangement 120, is held in fluid chamber 124, and is discharged from fluid end 100*b* through fluid discharge arrangement 128. Fluid end 100*b* is a relatively high pressure component of reciprocating pump 100.

Crankshaft 108 is arranged to drive reciprocating element arrangement 118 to pump fluid at relatively high pressure, i.e., fluid received at fluid intake arrangement 120. That is, crankshaft 108 drives reciprocating element arrangement 118 (via one or more connecting rods 116 and crossheads 112) to effectively cause fluid end 100*b* to deliver high pressure fluid through fluid discharge arrangement 128, e.g., to hydraulic fracturing, or fracking operations. Reciprocating element arrangement 118 may include any number of reciprocating plungers or pistons. That is, it should be appreciated that the high pressure fluid may also be provided for a wide variety of fracking and drilling operations. Thus, in at least some instances, the fluid or liquid may generally be a fracking liquid such as a mixture of water and sand that may effectively be injected into a rock formation at a relatively high pressure to enable natural oil and/or gas to be extracted from the rock formation. With each stroke of reciprocating element arrangement 118, a relatively low pressure fluid may be drawn into one or more fluid chambers 124 through fluid intake arrangement 120, and a relatively high pressure fluid may be discharged or expelled from fluid discharge arrangement 128.

In general, reciprocating pump 100 may be powered by a power source 232, such as an engine or turbine arrangement. FIG. 1 diagrammatically represents such an arrangement. transmission assembly 236 Power source 232 may be any suitable engine. For example, power source 232 may include a diesel engine and/or a turbine. Moreover, in some instances, power source 232 may include or be coupled to a transmission arrangement; however, often this transmission arrangement may be considered part of the power end 100*a*. Thus, for the purposes of this application, the power end 100*a* may be considered to begin at a drive input of a transmission assembly 236, regardless of whether the transmission assembly 236 is constructed with components of the power end 100*a* (e.g., with enclosed frame arrangement 104) or with components of power source 232.

Figure 3:
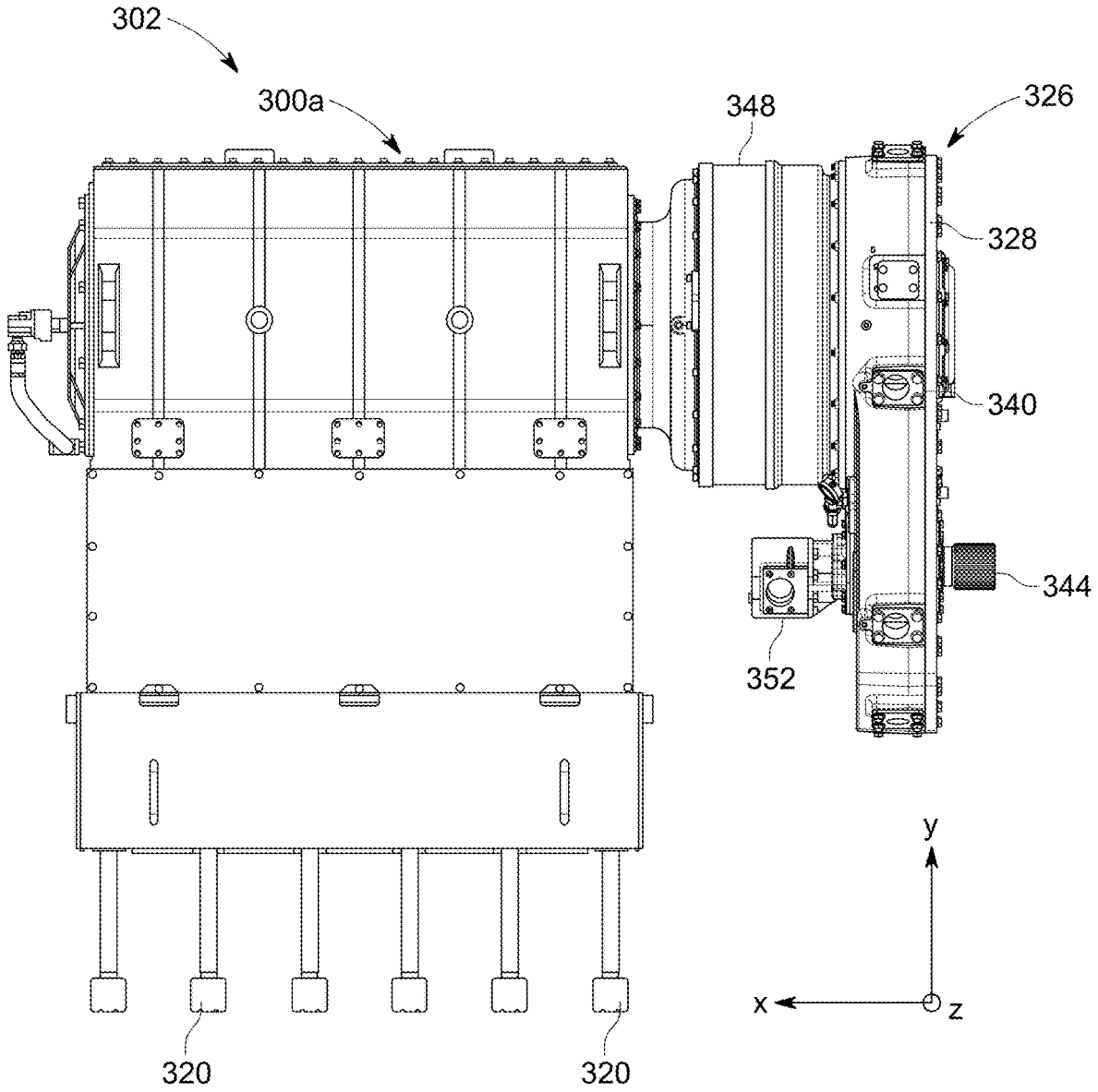
FIG. 3 (PRIOR ART)
FIG. 3 is a top-view representation of a prior art power end of a prior art high pressure reciprocating pump, e.g., power end 302 of FIG. 2.

With reference to FIG. 3, a power end assembly of a reciprocating pump that includes a transmission arrangement extending away from one side of its crankcase will be described. Power end 302 includes a crankcase 300*a* with couplers 320, e.g., stay rods, which are configured to connect the crankcase 300*a* to a fluid end. The couplers 320 may be considered part of power end 302 or part of the fluid end. Power end 302 also includes a transmission assembly 326 or, more generally, a power train, with a planetary gearbox 348 or planetary carrier, as well as an offset gearbox 328. Gearbox 328 includes an offset housing 340, a drive input 344, and a gearbox lube pump 352 through which a lubricant or lube may be provided to gearbox 328 and to all components in power end 302 (e.g., throughout all of gearbox 328, planetary gearbox 348, and crankcase 300*a*). Offset housing 340 provides an offset drive axis for a power source while interconnecting the power source with planetary gearbox 348.

Figure 2:
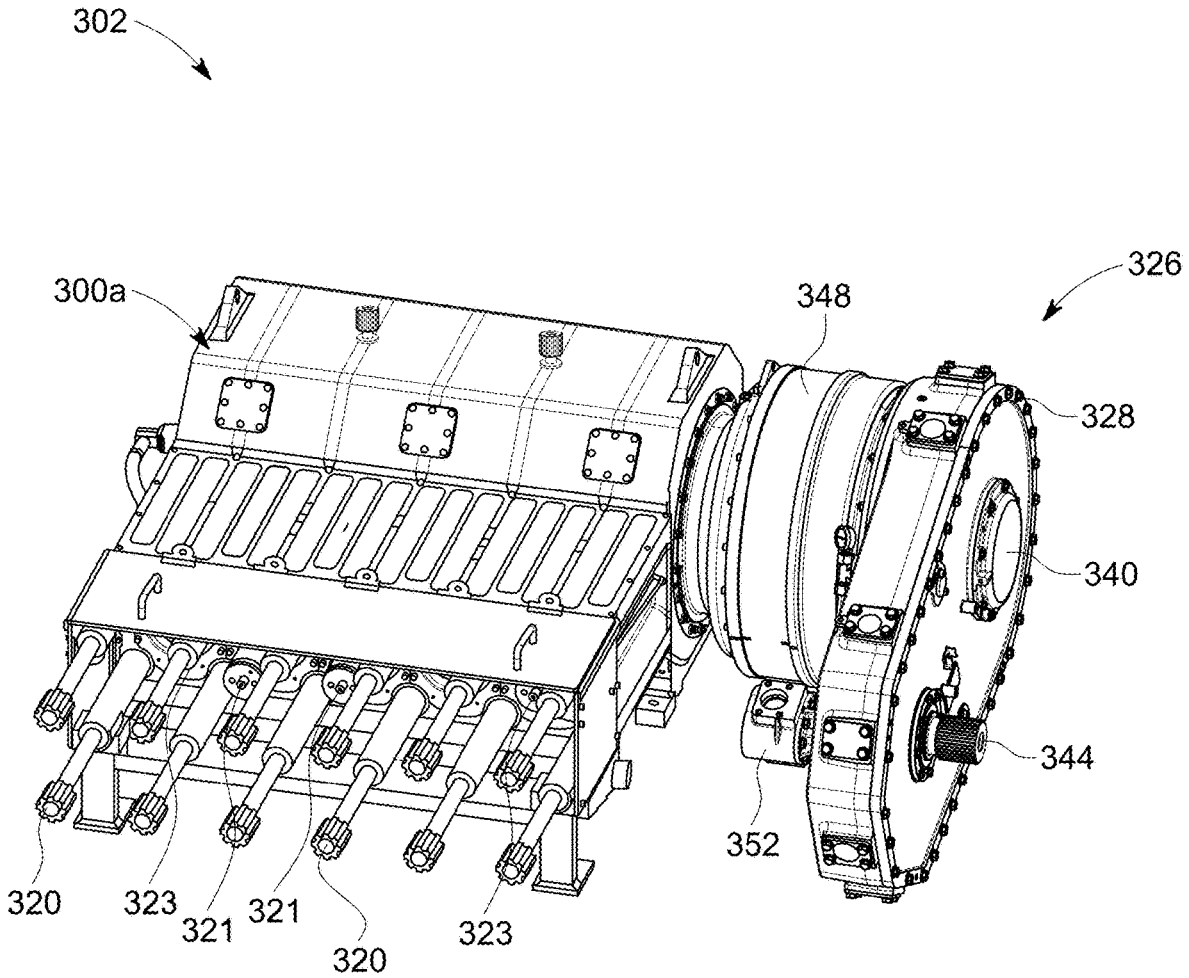
FIG. 2 (PRIOR ART)
FIG. 2 is a top perspective view of a prior art power end of a prior art high pressure reciprocating pump that has a gearbox assembly including a planetary gearbox and an offset gearbox.

Power end 302 also includes a crankshaft (not shown) positioned within crankcase 300*a*. Thus, lubricant pumped into power end 302 at gearbox lube pump 352 may lubricate the power end's crankshaft, which may effectively impart reciprocating elements, e.g., plungers, with reciprocating motion, e.g., via driving pony rods 321 of crosshead assemblies 323 by way of connecting rods (not shown in FIG. 2).

Figure 4:
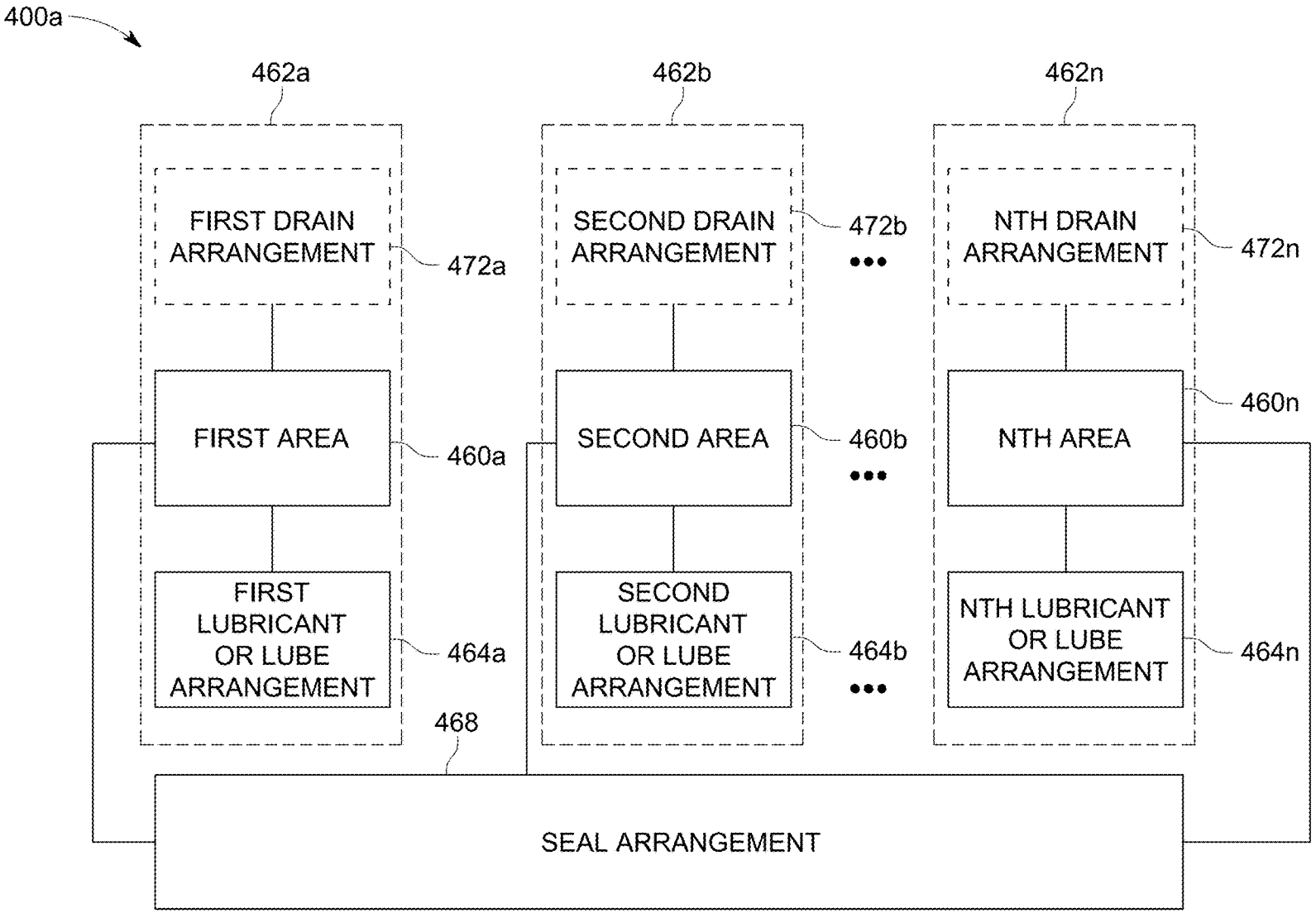
FIG. 4 is a block diagram representation of a power end of a high pressure reciprocating pump that includes multiple independent lube arrangements in accordance with an embodiment.

In one embodiment of the present application, a power end such as power end 302 may be reconfigured to support a plurality of independent lubricating or lube arrangements such that different components within power end 302 may be provided with different lubricants or lubes, e.g., oil. As previously mentioned, it may be beneficial for components to utilize lubes with different characteristics or properties to improve performance of some components and/or to substantially increase the lifetime of some components. FIG. 4 is a block diagram representation of a power end of a reciprocating pump that includes multiple independent lube arrangements in accordance with an embodiment. Power end 400*a* may effectively include multiple areas 460*a-n* defined therein that each include components of the power end. That is, each area 460*a-n* may include components that are substantially internal to power end 400*a*. For example, first area 460*a* may include at least a first component, second area 460*b* may include at least a second component, and Nth area 460*n* may include at least an nth component. Components included in areas 460*a-n* are generally arranged to be lubricated. Although three areas 460*a-n* are shown, it should be appreciated that there may be fewer or more than approximately three areas. Areas 460*a-n* are independent areas that are isolated from each other. That is, areas 460*a-n* are substantially separate.

Each area 460*a-n* has an associated lubricant or lube arrangement 464*a-n*, respectively. For example, first area 460*a* may be associated with first lube arrangement 464*a*, second area 460*b* may be associated with second lube arrangement 464*b*, and Nth area 460*n* may be associated with Nth lube arrangement 464*n*. Lube arrangements 464*a-n* are configured to provide lubricant or lube to areas 460*a-n*, respectively, and may include, but are not limited to including, lube reservoirs and lube pumps.

Areas 460*a-n* may be substantially separated using a seal arrangement 468. Seal arrangement 468 may include one or more seals, e.g., seals formed from a soft or flexible material, which are arranged to essentially contain lube in specific areas 460*a-n*, and to effectively prevent lube from leaking out of specific areas 460*a-n*. One or more seals included in seal arrangement 468 may be membranes that cause lube to be contained within each area 460*a-n*. For example, seal arrangement 468 may cause lube associated with first lube arrangement 464*a* to be contained within first area 460*a*, lube associated with second lube arrangement 464*b* to be contained within second area 460*b*, and lube associated with Nth lube arrangement 464*n* to be contained within Nth area 460*n*. It should be appreciated that although seal arrangement 468 generally includes seals, seal arrangement 468 may additionally, or alternatively, include any suitable mechanical mechanism that may facilitate isolating areas 460*a-n* from each other.

Power end 400*a* also includes optional drain arrangements 472*a-n*. Drain arrangement 472*a-n* may be arranged to each include one or more drain ports that may be used to substantially divert lube from areas 460*a-n*, respectively. That is, first drain arrangement 472*a* may enable lube to be drained from first area 460*a*, second drain arrangement 472*b* may enable lube to be drained from second area 460*b*, and Nth drain arrangement 472*n* may enable lube to be drained from Nth area 460*n*. Lube may be diverted from areas 460*a-n* to one or more separate reservoirs or tanks. In one embodiment, one or more drain arrangements 472*a-n* may be configured as drain ports defined in surfaces that define areas 460*a-n*, respectively.

First area 460*a*, first lube arrangement 464*a*, and optional first drain arrangement 472*a* form a first lube system 462*a*. Second area 460*b*, second lube arrangement 464*b*, and optional second drain arrangement 472*b* form a second lube system 462*b*. Nth area 460*n*, Nth lube arrangement 464*n*, and optional Nth drain arrangement 472*a* form an Nth lube system 462*n*.

Figure 5:
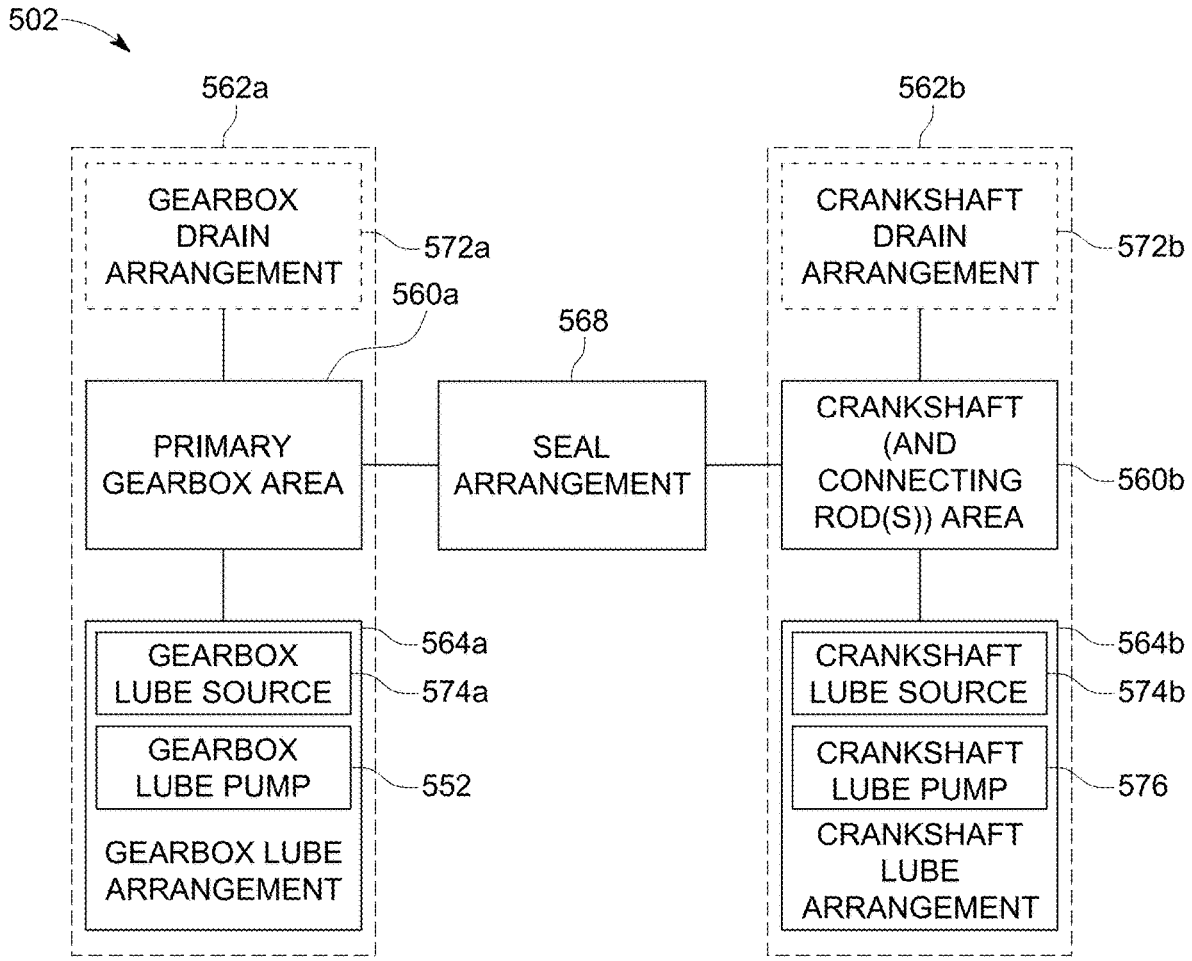
FIG. 5 is a block diagram representation of a power end of a high pressure reciprocating pump that includes two independent lube arrangements in accordance with an embodiment.

In one embodiment, a power end of a reciprocating pump may include a transmission assembly (or drive train) and a crankcase that have separate, isolated lube systems which may be separated by a seal arrangement that includes at least one seal or sealing feature. FIG. 5 is a block diagram representation of a power end 502 that includes two independent lube arrangements in accordance with an embodiment. The power end 502 includes a primary gearbox area 560*a* that includes one or more gears and a crankshaft area 560*b*, e.g., a crankcase of a power end, which may also include a crankshaft and one or more connecting rods, among other components. Primary gearbox area 560*a* and crankshaft area 560*b* are substantially separated by a seal arrangement 568. Seal arrangement 568 may be positioned substantially between primary gearbox area 560*a* and crankshaft area 560*b*.

Primary gearbox area 560*a* is associated with a gearbox lube arrangement 564*a* that is configured to provide lube that has characteristics suitable for primary gearbox area 560*a*, e.g., a lube that has additives and a relatively high viscosity. Gearbox lube arrangement 564*a* includes a gearbox lube source 574*a*, which may be a reservoir or a tank, which contains a lube prior to the lube being pumped into primary gearbox area 560*a* by a gearbox lube pump 552. Primary gearbox area 560*a* may effectively have an optional gearbox drain arrangement 572*a* that includes drain features suitable to drain a lube from primary gearbox area 560*a*.

Crankshaft area 560*b* is associated with a crankshaft lube arrangement 564*b* that is configured to provide lube that has characteristics suitable to lubricate a crankshaft contained in crankshaft area 560*b*. Additionally or alternatively, the lube may be suitable to lubricate crosshead assemblies in crankshaft area 560*b* of the crankcase, in which pony rods reciprocate, e.g., due to one or more connecting rods driving the pony rods due to rotational movement of the crankshaft. By way of example, the lube used in crankshaft area 560*b* may have a lower viscosity than the lube used in primary gearbox area 560*a*, and may be selected to substantially extend the lifetime of a crankshaft and other such components in crankshaft area 560*b* over the lifetime associated with the use of the same lube as used in primary gearbox area 560*a*. In other words, the lube used in primary gearbox area 560*a* may have a higher viscosity than the lube used in crankshaft area 560*b*. Crankshaft lube arrangement 564*b* includes a crankshaft lube source 574*b* and a crankshaft lube pump 576. Crankshaft lube source 574*b* may be a reservoir from which crankshaft lube pump 576 may obtain a lube to be provided to crankshaft area 560*b*. Crankshaft area 560*b* may have an optional associated crankshaft drain arrangement 572*b*.

The optional gearbox drain arrangement 572*a* may comprise any combination of drain features, as for example one or more drain ports, which enable lube to be diverted from primary gearbox area 560*a* as appropriate. Similarly, the optional crankshaft drain arrangement 572*b* may include any combination of drain features which enable lube to be diverted from crankshaft area 560*b* as appropriate. It should be appreciated that lube may be diverted to separate reservoirs or tanks and/or back to lube sources 574*a*, 574*b*, respectively.

In general, gearbox lube arrangement 564*a*, primary gearbox area 560*a*, and optional gearbox drain arrangement 572*a* form a gearbox lube system 562*a*. Similarly, crankshaft lube arrangement 564*b*, crankshaft area 560*b*, and optional crankshaft drain arrangement 572*b* form a crankshaft lube system 562*b*. Gearbox lube system 562*a* and crankshaft lube system 562*b* are effectively separated by seal arrangement 568. However, to be clear, the term "gearbox" as used in "gearbox lube system 562*a*" is not intended to be limiting and this system may be suitable for any transmission assembly or portion thereof. Likewise, the term "crankshaft" as used in "crankshaft lube system 562*b*" is not intended to be limiting and this system may be suitable for any components included in the crankcase or main housing of the power end, which may include or not include the crankshaft.

Figure 6:
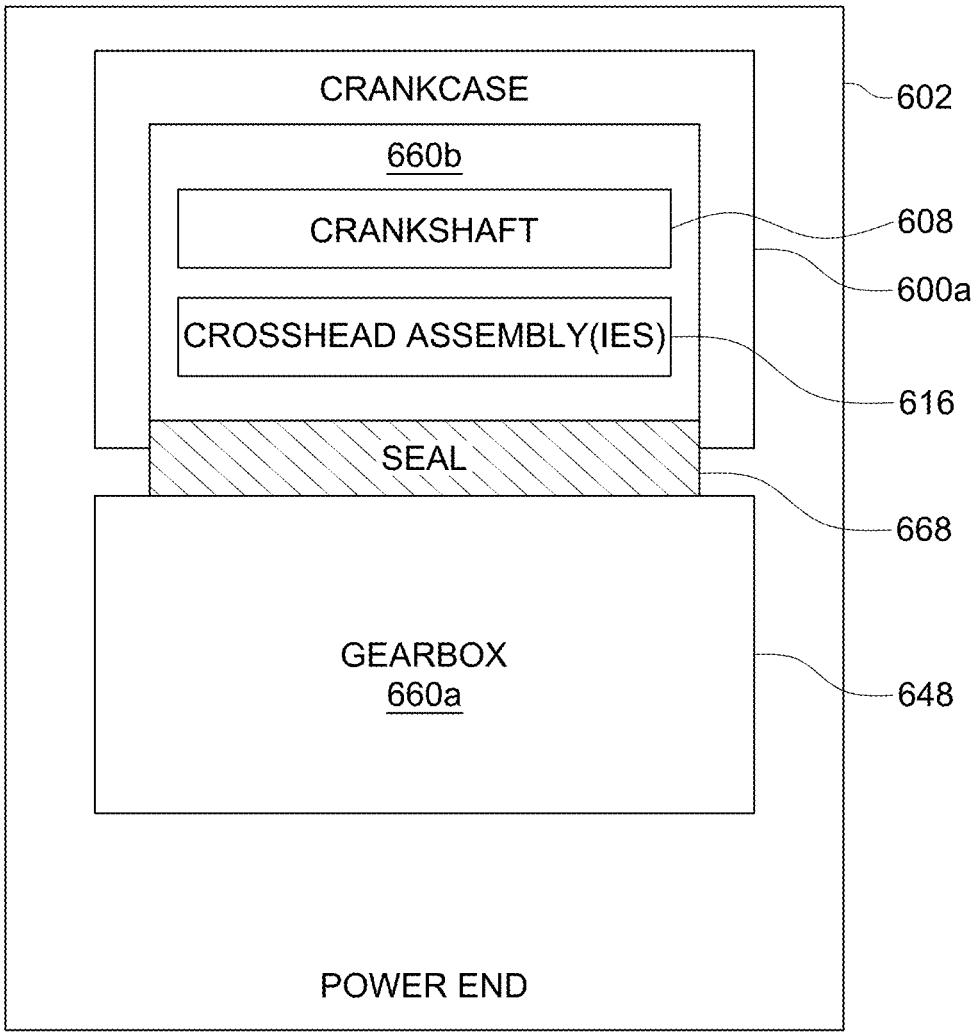
FIG. 6 is a block diagram representation of a power end with areas that contain different lubes in accordance with an embodiment.

As shown in FIG. 6, a power end 602 may include a crankcase 600*a* and a gearbox 648. A crankshaft 608 and one or more crosshead assemblies 616 may be included in a crankcase 600*a*. A seal arrangement 668 may substantially isolate gearbox 648 from crankcase 600*a*. Seal arrangement 668 may define a first area 660*a*, or a first lube area, within gearbox 648 and a second area 660*b*, or a second lube area, which contains crankshaft 608 and one or more crosshead assemblies 616. That is, seal arrangement 668 is arranged to create first area 660*a* and second area 660*b*, which are isolated or substantially separated from each other. Area 660*a* may contain a first lube and area 660*b* may contain a second lube. In one embodiment, the first lube and the second lube have different characteristics, e.g., different viscosities.

In one embodiment, seal arrangement 668 may be positioned within or formed by a planetary dam of planetary gearbox 648. As is described in further detail below, a planetary dam of gearbox 648 may be a lube dam, or a cover, that effectively directs the flow of lube with respect to planetary gearbox 648. Planetary dam is included in area 660*b* that contains a second lube. Thus, area 660*b* as at least partially defined by seal arrangement 668 contains a second lube such that planetary dam may direct the flow of the second lube. However, seal 668 need not be entirely disposed in gearbox 648 and may extends across both gearbox 648 and crankcase 600*a*. Alternatively, seal 668 may be disposed entirely in crankcase 600*a*.

Figure 7A:
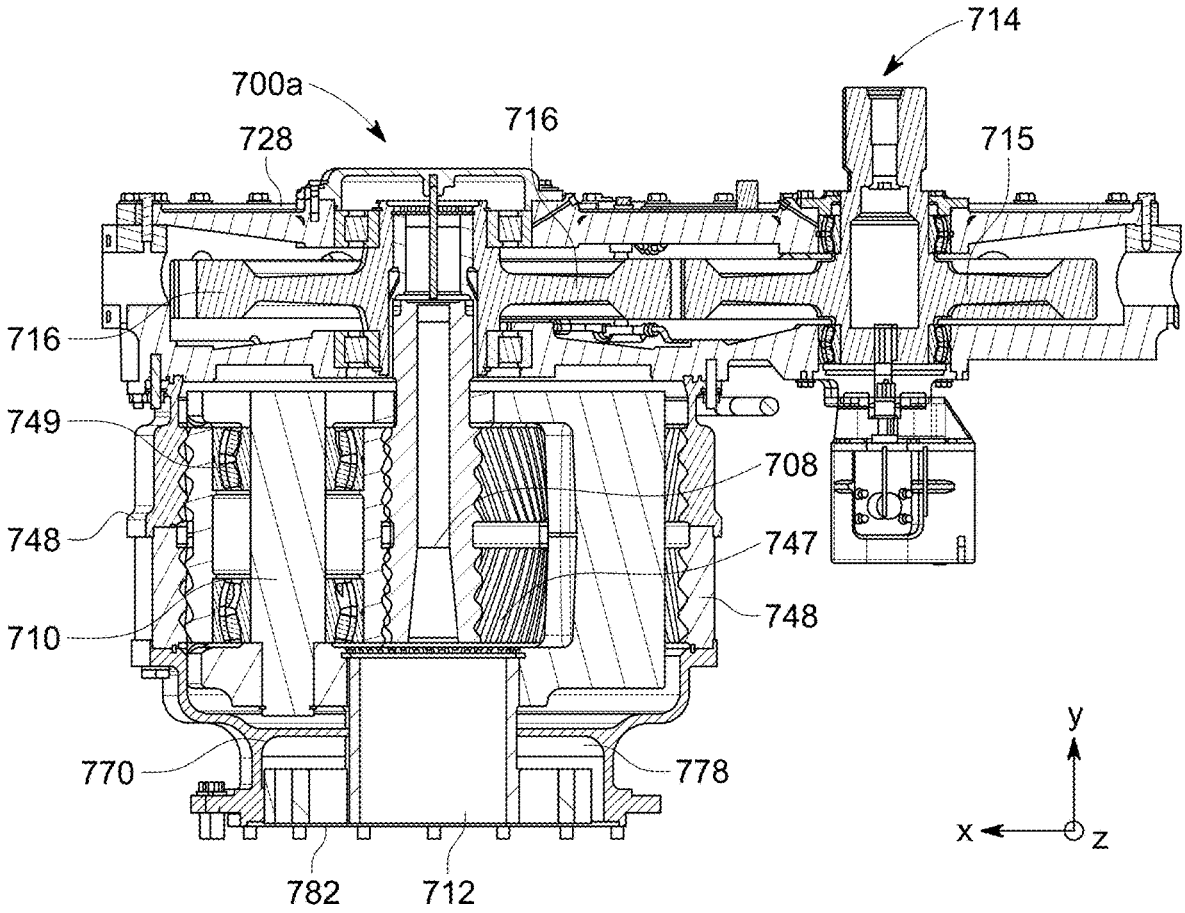
FIG. 7A is a diagrammatic representation of an offset gearbox and a planetary gearbox or a planetary carrier that includes a seal in accordance with an embodiment.
Figure 7B:
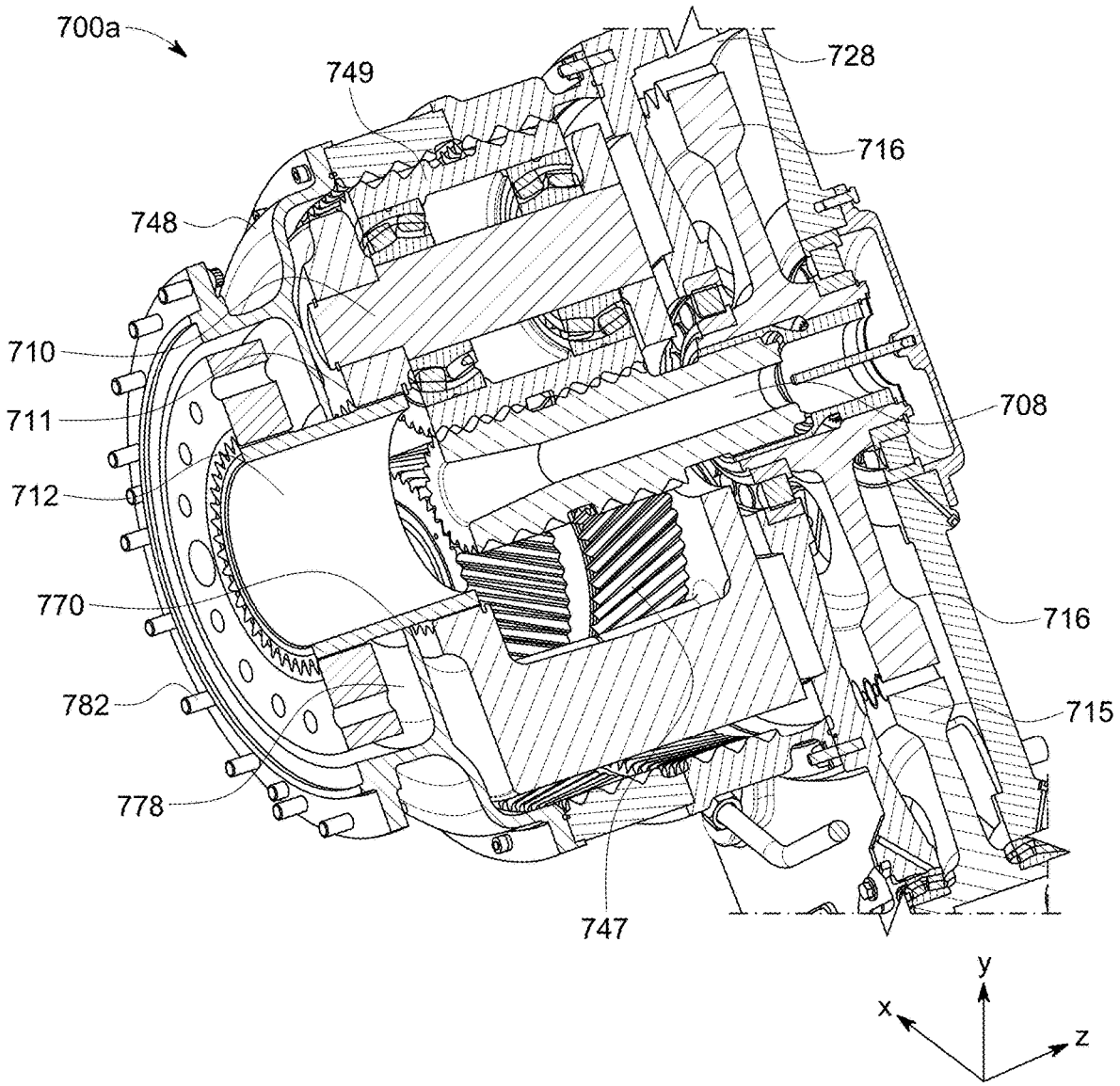
FIG. 7B is a diagrammatic cross-sectional representation of an offset gearbox and a planetary gearbox or a planetary carrier that includes a seal, e.g., offset gearbox 728 and planetary gearbox 748 of FIG. 7A, in accordance with an embodiment.

When seal arrangement 668 is disposed in a planetary dam, the seal arrangement 668 may include at least one seal that seals off a portion of planetary dam such that planetary dam is substantially contained within second area 660*b*. FIGS. 7A and 7B are diagrammatic representations of gearbox assembly or drive train 700*a* that includes a seal 778 which seals off the transmission assembly 700*a*, e.g., from the crankcase, in accordance with an embodiment. In these Figures, the transmission assembly 700*a* includes an offset gearbox 728 is coupled to a planetary gearbox 748 or planetary carrier. The planetary gearbox 748 includes a planetary dam 770 that is positioned between planetary gearbox 748 and a flange interface 782 that is arranged to be coupled to a power end crankcase or main housing. As shown, a seal 778 which may be a soft membrane is arranged to seal off planetary dam 770. Or, from another perspective, planetary dam 770 supports seal 778 to seal the planetary gearbox 748 adjacent flange interface 782.

Due to seal 778 and/or dam 770, internal components of the planetary gearbox 748 and the offset gearbox 728 are now disposed in an isolated area associated with a lube system (e.g., isolated from components to which the transmission assembly 700*a* may be attached via flange 782). Among other components, the following components may all be disposed in the isolated area: (a) a portion of drive input shaft 714; (b) transmission gears 715 and 716 of the offset gearbox 728; (c) transmission gears 711, 747 and 749 of the planetary gearbox 748; (d) a transmission drive shaft 708 operatively coupling gear 716 to gears 747; (e) a main drive shaft 710; and (f) a portion of a drive line shaft 712, which is configured to drive movement of a crankshaft in the crankcase (not shown). Seal 778 essentially prevents lube or oil in offset gearbox 728 and/or planetary gearbox 748 from leaving the offset gearbox 728 and/or planetary gearbox 748, e.g., to prevent this lube or oil from mixing with lube contained in a crankcase to which the transmission assembly 700*a* is coupled. That is, seal 778 retains lube or oil used with the various gears and drive shafts of transmission assembly 700*a* for use by these components. The lube may primarily lubricate mesh points between these components.

In one embodiment, planetary dam 770 may be a separating wall that substantially prevents lube in planetary gearbox 748 from mixing with lube contained in a crankcase (not shown). The separating wall may cooperate with a seal 778, which may be a rubber seal or gasket, to hold back any lube or lube mist from seeping through from one side of separating wall and seal 778 to the other.

Notably, during operations of transmission assembly 700*a*, a power sources, such as an engine or turbine may drive rotation of drive input shaft 714. This rotates transmission gear 715 which intermeshes with and drives rotation of transmission gear 716. Transmission gear 716 is configured to rotate transmission drive shaft 708, which transmits rotational motion from offset gearbox 728 to planetary gearbox 748. In planetary gearbox 748, transmission gears 747 intermesh with and drive rotation of transmission gears 749 which are configured to drive rotation of main drive shaft 710. Main drive shaft 710 is connected to drive line shaft 712 via transmission gear 711 and drive line shaft 712 is configured to interface with components exterior of the transmission assembly 700*a*, such as the crankshaft of a power end. All of these mesh points require lubricant, and the lube systems presented herein are configured to provide dedicated lube in an isolated zone for these mesh points.

Figure 7C:
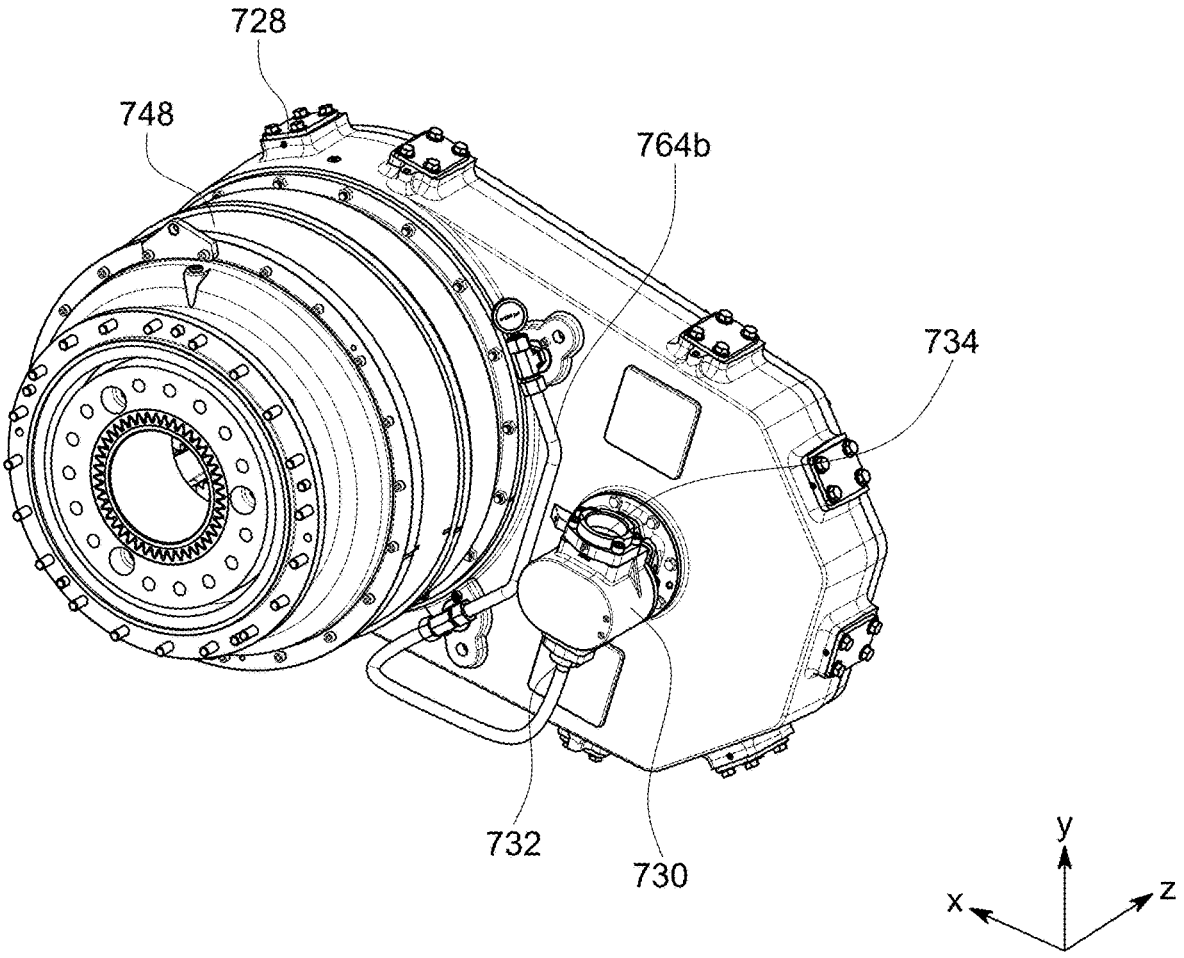
FIG. 7C is a side perspective view of an offset gearbox and a planetary gearbox or a planetary carrier e.g., offset gearbox 728 and planetary gearbox 748 of FIG. 7A, which shows a lube system that is configured to provide a lube to the planetary gearbox in accordance with an embodiment.
Figure 7D:
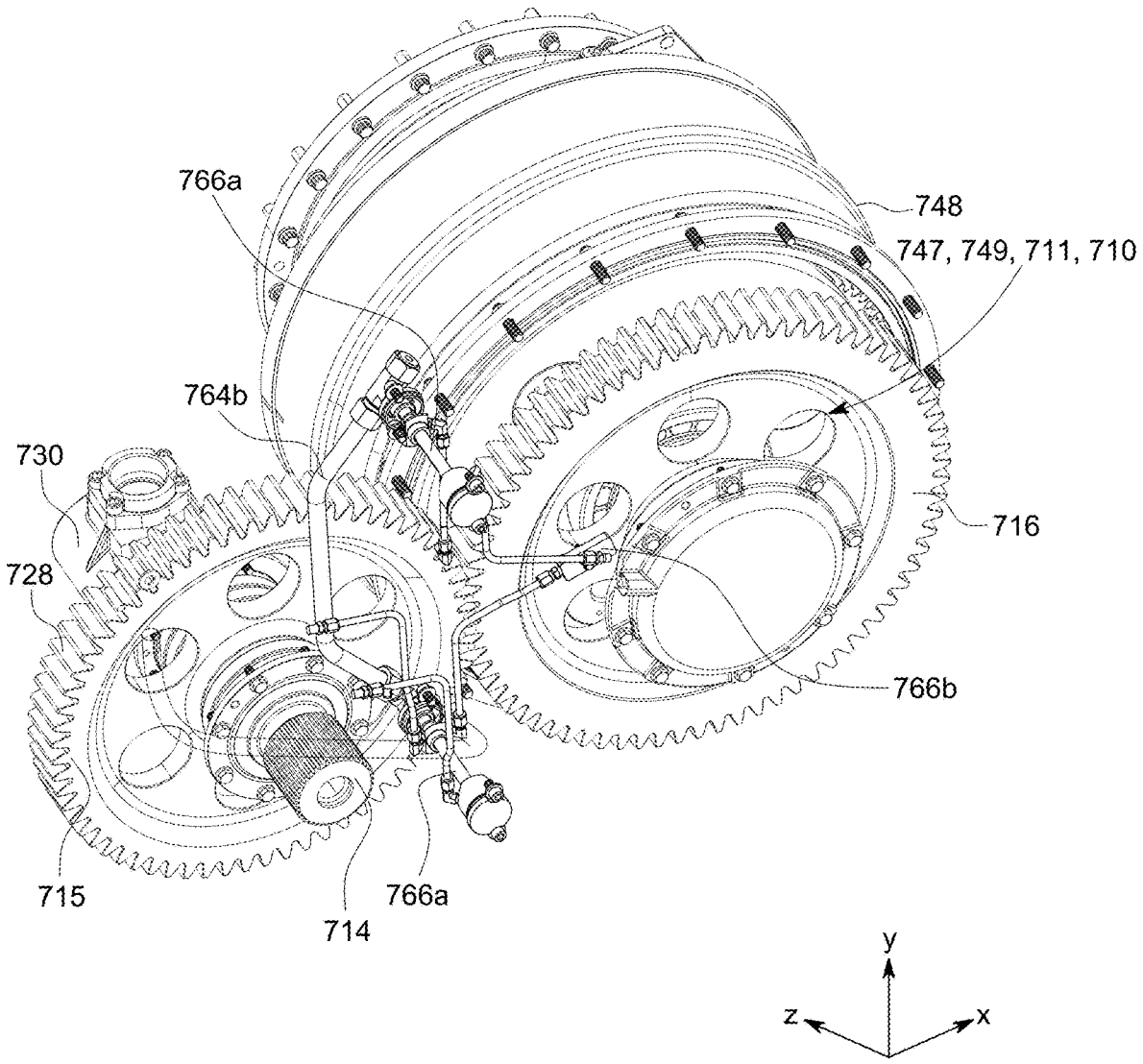
FIG. 7D is a diagrammatic representation of internal components of an offset gearbox and a planetary gearbox or a planetary carrier e.g., offset gearbox 728 and planetary gearbox 748 of FIG. 7A, which shows components of a lube system that is configured to provide a lube to the internal components in accordance with an embodiment.

Referring next to FIGS. 7C and 7D, a lube system for a transmission assembly or drive train 700*a* will be described in accordance with an embodiment. In this embodiment, a lube manifold 764*b* provides lube for distribution inside planetary gearbox 748 and offset gearbox 728. Lube manifold 764*b* may generally be coupled to any suitable mechanism that enables lube to be distributed in planetary gearbox 748 and offset gearbox 728. For example, a pump 732 may be coupled to the power take off (PTO) 730, which allows rotation of the drive input shaft 714 (of offset gearbox 728) to drive operation of pump 732. The pump 732 may be able to draw in suction via an opposite, suction side 734 of the PTO 730. As shown in FIG. 7D, lube manifold 764*b* distributes lube inside planetary gearbox 748 and offset gearbox 728 via distribution mechanisms including, but are not limited to including, spray bar and nozzles 766*a* and spray block and nozzles 766*b*. Nozzles 766*a* and nozzles 766*b* may generally be aligned with mesh points between the various gears and shafts of transmission assembly 700*a* (e.g., shafts 714, 708, 710, and 712 and gears 715, 716, 711, 749, and 747). For example, nozzles 766*b* may be aligned with a mesh points in offset gearbox 728 (e.g., between gears 715 and 716) while nozzles 766*a* are aligned with mesh points in the planetary gearbox 748.

Figure 8:
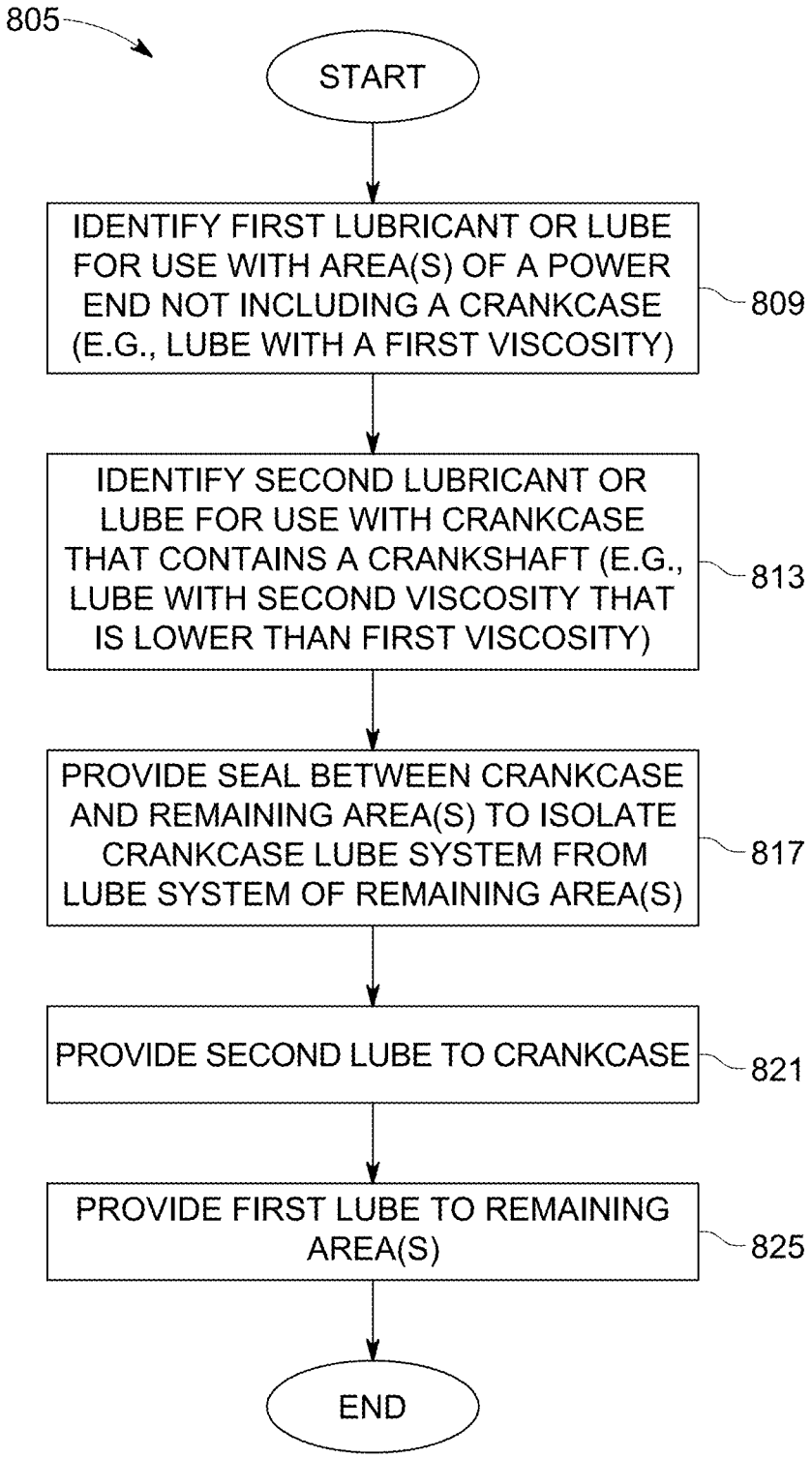
FIG. 8 is a process flow diagram which illustrates a method of providing a power end of a high pressure reciprocating pump with more than one independent lube area in which lubes of different characteristics may be utilized in accordance with an embodiment.

Referring nest to FIG. 8, a method of maintaining a power end of a reciprocating pump that includes more than one independent lube area in which lubes of different characteristics may be utilized will be described in accordance with an embodiment. A method 805 of maintaining a power end of a reciprocating pump begins at a step 809 in which a first lubricant or lube that is suitable for use outside the crankcase, e.g., to lubricate components of the power end transmission assembly, is identified. A first lube that is suitable for use with this area, e.g., with the transmission assembly, may be a lube with a first viscosity, for example.

In a step 813, a second lubricant or lube is identified for use with the crankcase. The crankcase typically contains a crankshaft, among other components. The second lube may generally have a second viscosity that is different from the viscosity of the first lube. For example, the second lube may have a substantially lower viscosity than the first lube. The second lube may have other characteristics that differ from characteristics of the first lube, e.g., the second lube may include different additives than those included in the first lube.

Once the second lube is identified, a seal is provided between the crankcase and the remaining areas, e.g., the transmission assembly, in a step 817 to isolate the crankcase lube system from remaining areas of the power end. Isolating the lube systems generally includes isolating an area associated with the crankcase from the areas of the transmission assembly. It should be appreciated that other mechanisms, such as a wall, may be provided in addition to a seal to enable the crankcase lube system to be isolated from the lube system of transmission assembly.

After the seal isolates the crankcase and, hence, a crankshaft from other areas, such as the transmission assembly, the second lube is provided to the crankcase in a step 821. Then, in a step 825, the first lube is provided to the transmission assembly, and the method of maintaining a power end of a reciprocating pump is completed.

The use of a seal arrangement to substantially provide separate lube areas associated with a power end is not limited to use with the specific reciprocating pump described above. For example, in a high pressure reciprocating pump with a bull gear and pinion style transmission, areas that may be sealed include an area that includes outer main bearings on a crankshaft and an area that includes pinion shaft bearings. The bull gear shaft on a crankshaft may be sealed, i.e., sealing may be made around the bull gear shaft on the crankshaft. With respect to FIG. 4, a bull gear on a crankshaft may be associated with first area 460*a*, the crankshaft may be associated with second area 460*b*, and sealing may be accomplished by seal arrangement 468. In one embodiment, a custom housing may be created to be substantially mounted over an area of an outer main bearing and include an opening for a bull gear shaft to pass therethrough. Such an opening may support a seal that retains oil for each lube system, as for example the lube system associated with the outer main bearings on the crankshaft and the lube system associated with an area that includes the crankshaft. A similar opening may also be provided for the pinion shaft,. e.g., to retain the pinion in the isolated zone with the bull gear while sealing the zone with respect to the crankcase. That is, it should be understood that a similar custom housing may also be created for use to mount over an area of a pinion gear.

Figure 9:
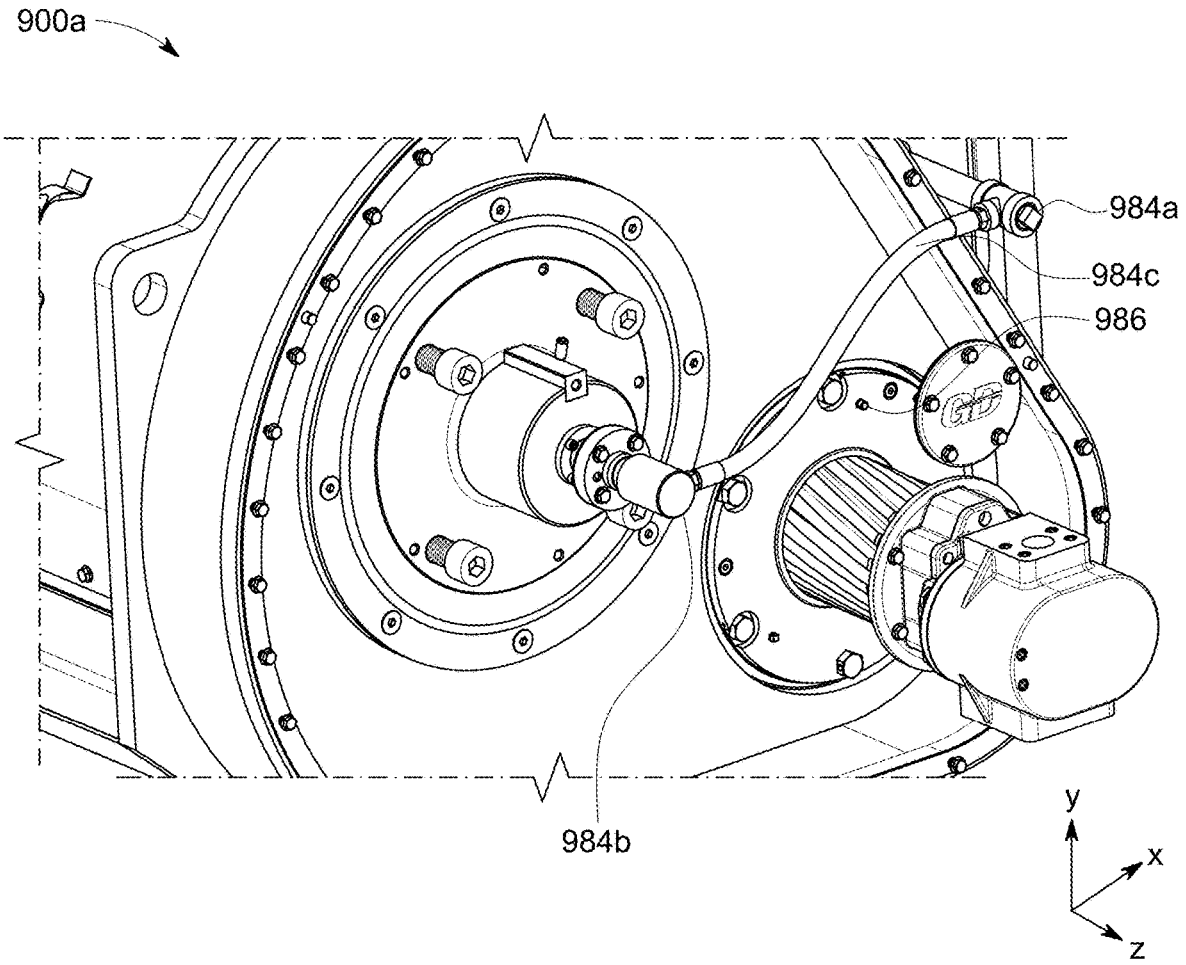
FIG. 9 (PRIOR ART)
FIG. 9 is a side perspective view of a prior art power end including a bull gear and pinion style transmission arrangement.
Figure 10A:
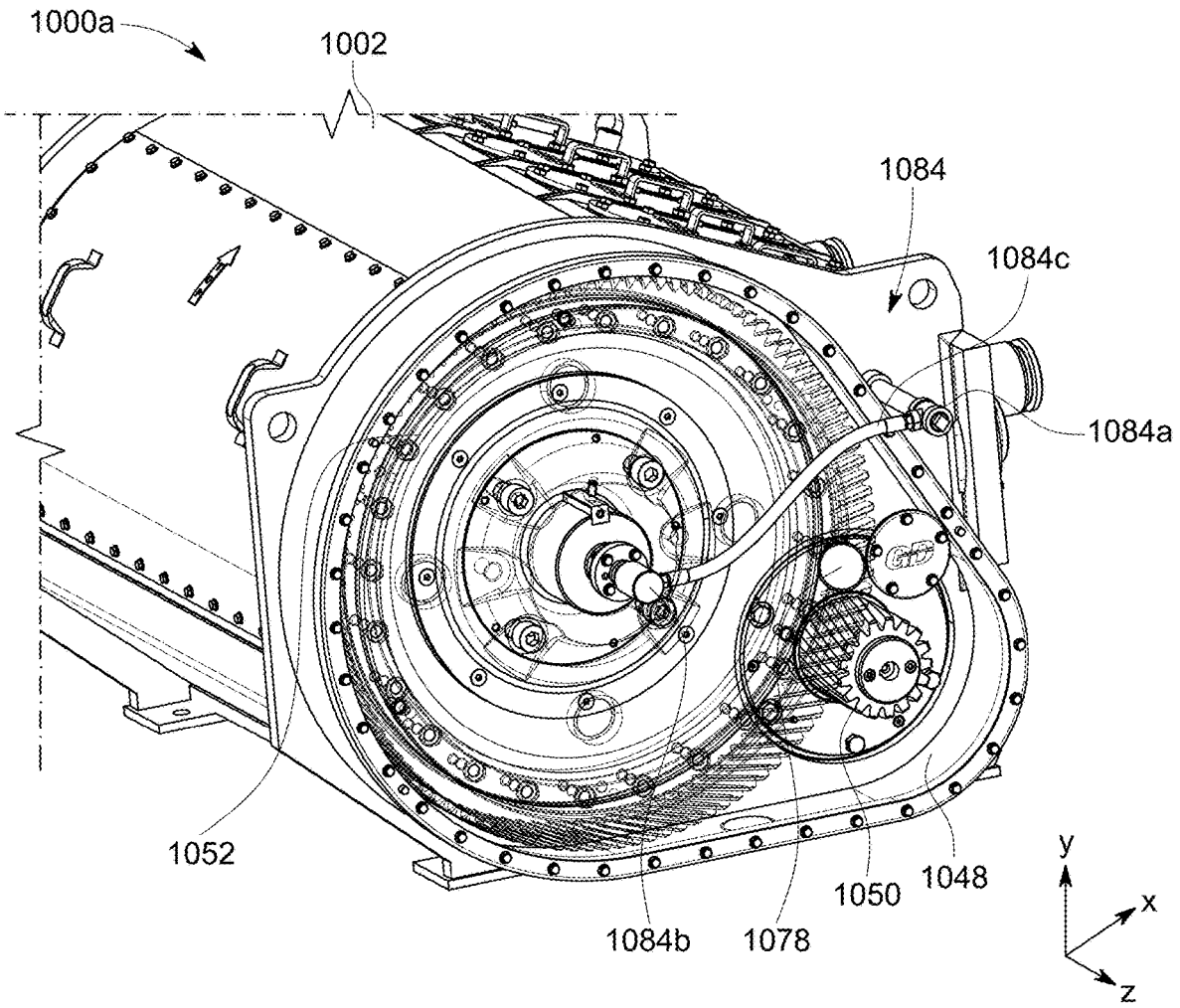
FIG. 10A is a diagrammatic side view representation of a power end including a bull gear and pinion style transmission arrangement, which shows internal components of the transmission arrangement in accordance with an embodiment.
Figure 10B:
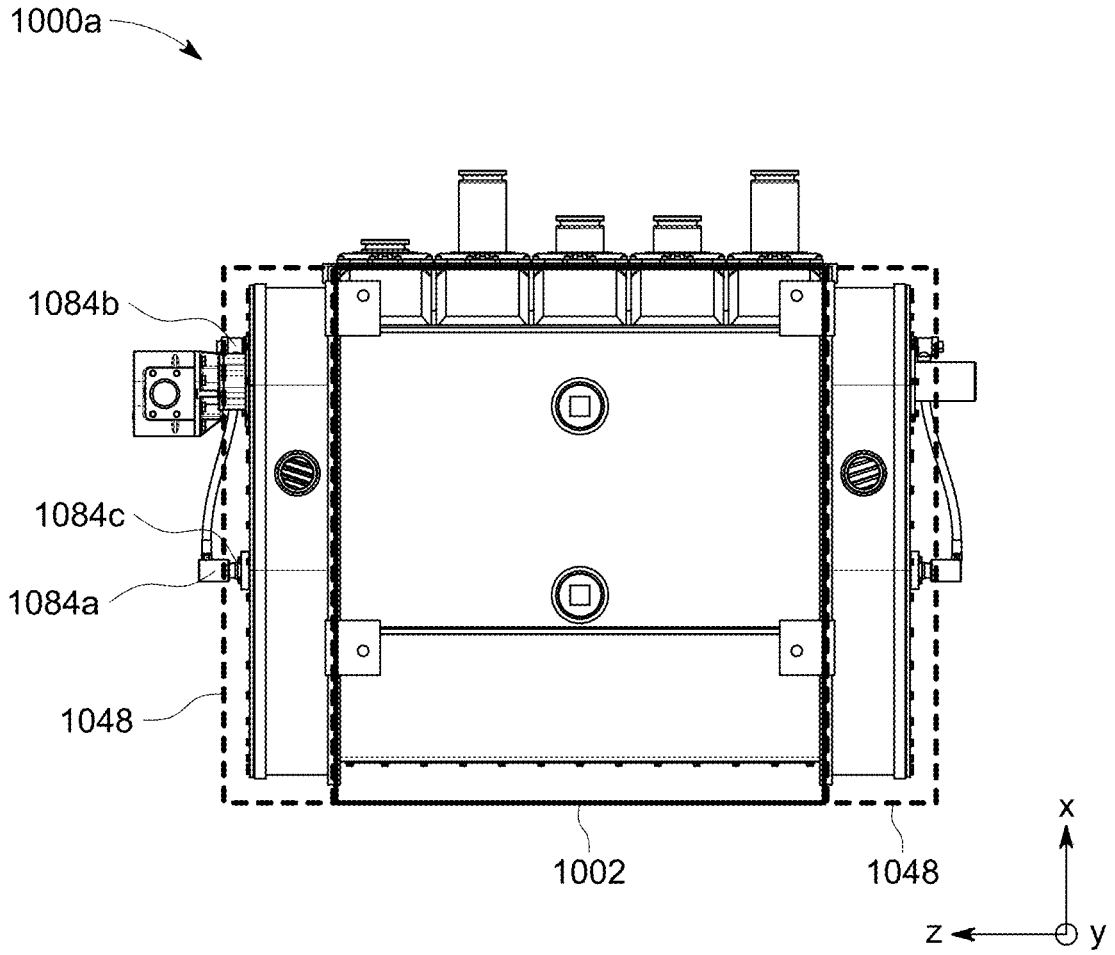
FIG. 10B is a top view of a power end including a bull gear and pinion style transmission arrangement, e.g., power end 1000*a* of FIG. 10A, in accordance with an embodiment.
Figure 10C:
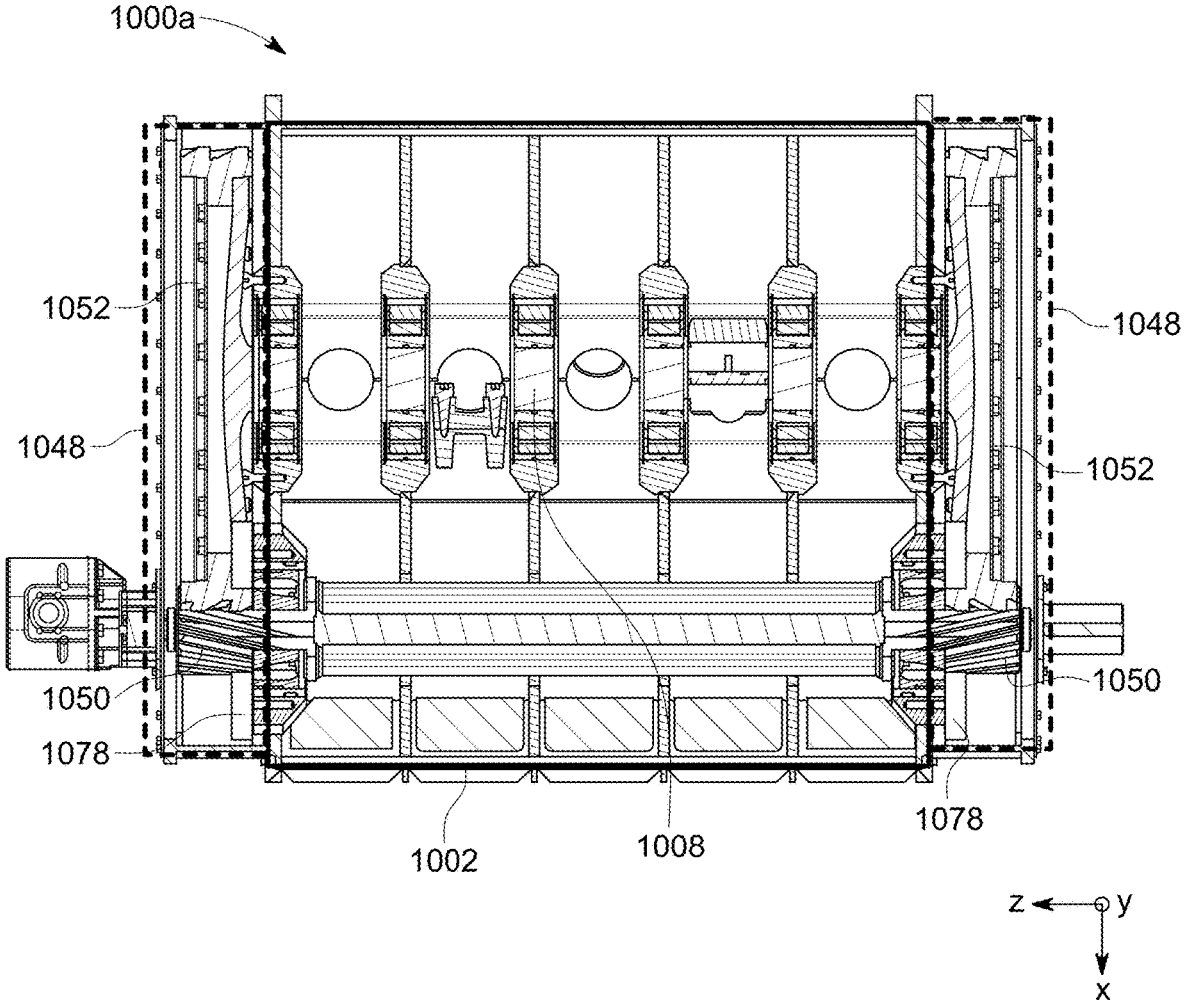
FIG. 10C is a diagrammatic cross-sectional representation of a power end including a bull gear and pinion style transmission arrangement, e.g., power end 1000*a* of FIG. 10A, in accordance with an embodiment.
Figure 10D:
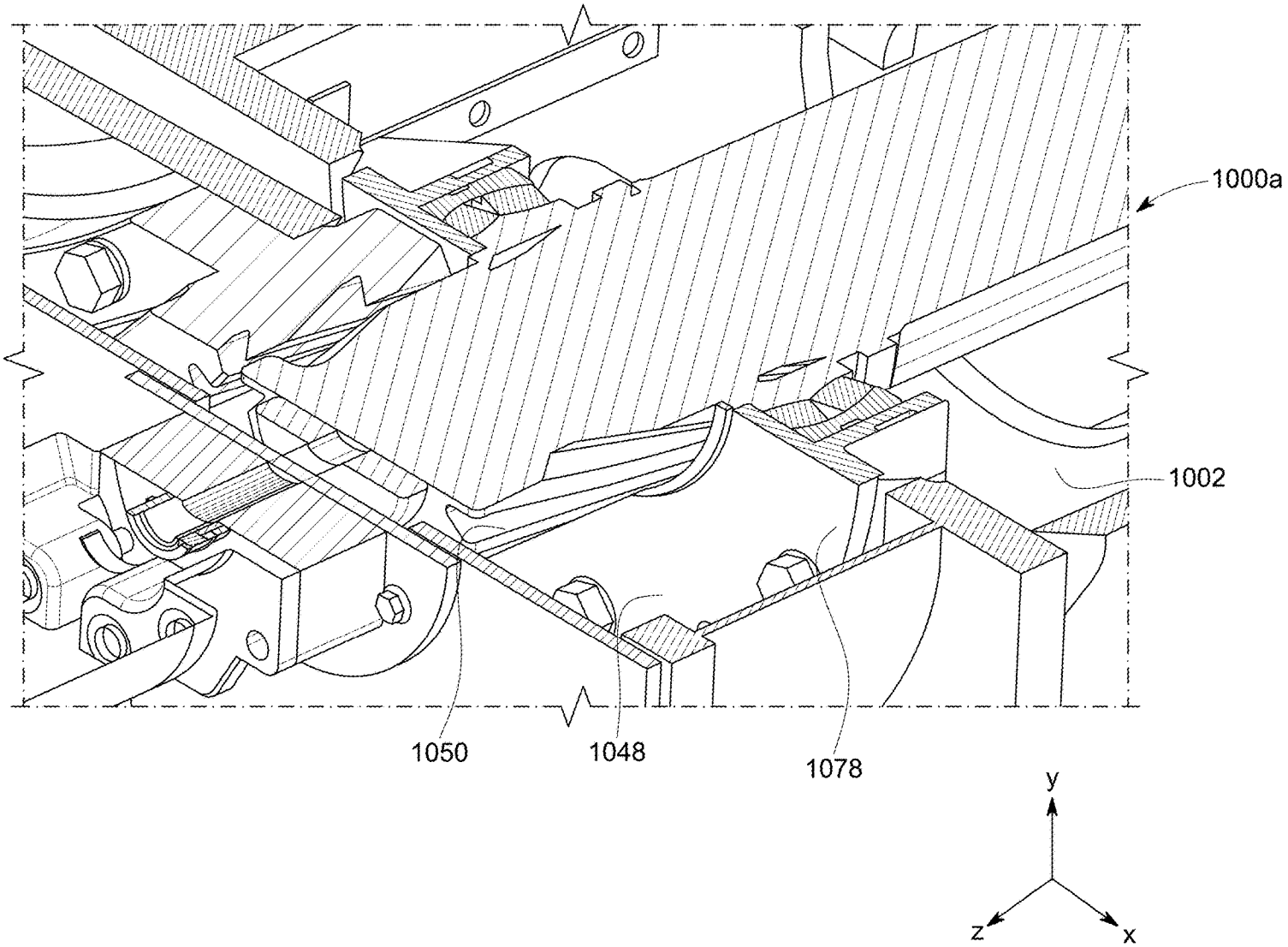
FIG. 10D is a diagrammatic cross-sectional cut-away representation of a power end including a bull gear and pinion style transmission arrangement, e.g., power end 1000*a* of FIG. 10A, in accordance with an embodiment.

FIG. 9 is a diagrammatic representation of a prior art power end with a bull gear and pinion style transmission, albeit with the bull gear and pinion removed. Power end 900*a* generally includes a lube system which provides lubricant to power end 900*a*. The lube system includes a power end lube manifold inlet 984*a*, a power end lube passthrough 984*b*, and a hose 984*c* that carries lube between manifold inlet 984*a* and passthrough 984*b*. Passthrough 984*b* provides lube to a crankshaft and journal bearings within power end 900*a*. In this prior art power end 900*a*, an opening 986 enables lube to substantially flow out of power end 900*a* to lubricate gears (not shown) that are external to power end 900*a*. Thus, the same lubricant is used to lubricate both the transmission (e.g., the bull gear and pinion) and the crankshaft and other components inside the crankcase.

In accordance with one embodiment, a seal arrangement may be provided in a power end with a bull gear and pinion style transmission assembly to enable a first lube to be provided in a crankcase of the power end and a second lube to be provided to lubricate the transmission assembly. With reference to FIGS. 10A-D, a power end 1000*a* with a sealed and separately lubricated gearbox of a bull gear and pinion style is shown in accordance with an embodiment. Power end 1000*a* includes a lube system 1084 that is similar to prior art lube systems, and thus, includes a power end lube manifold inlet 1084*a*, a power end lube passthrough 1084*b*, and a hose 1084*c* that carries lube between manifold inlet 1084*a* and passthrough 1084*b*. However, now, a seal arrangement 1078 which includes one or more seals is arranged interiorly of the pinion gear 1050 to enable different lubes to be used in a crankcase 1002 of power end 1000*a* and the gearbox 1048 of power end 1000*a*. That is, seal arrangement 1078 substantially separates power end 1000*a* and gearboxes 1048 such that power end 1000*a* may utilize two different lubes with different characteristics. In some embodiments, a similar seal may also be included interiorly of bull gear 1052, e.g., to seal any openings between the bull gear 1052 and the crankcase 1002.

One or more nozzles or sprayers (not shown) or any other mechanisms for distributing lube may provide a first lube to gearbox 1048 to lubricate gears 1050 and 1052 within gearbox 1048 and, more specifically, to lubricate the mesh point between pinion gear 1050 and bull gear 1052. Meanwhile, power end lube manifold inlet 1084*a*, power end lube passthrough 1084*b*, and a hose 1084*c* cooperate to provide a second lube to lubricate a crankshaft 1008 and any other lubricant requiring components within the crankcase 1002 of power end 1000*a*.

Figure 11:
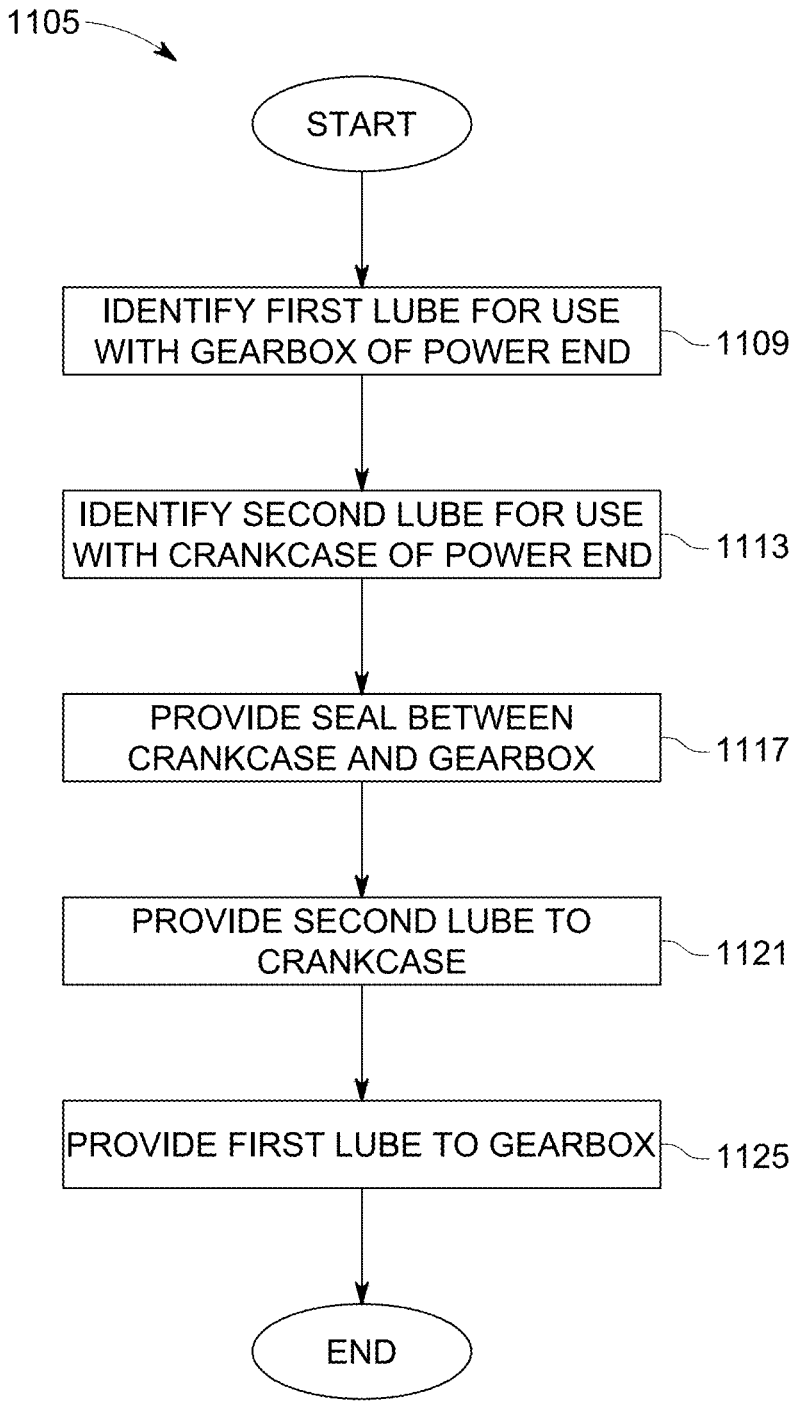
FIG. 11 is a process flow diagram which illustrates a general method of providing a pump including a bull gear and pinion style transmission arrangement with different lubes in accordance with an embodiment.

FIG. 11 is a process flow diagram which illustrates a general method of providing a power end with a bull gear and pinion style transmission assembly with different lubes in accordance with an embodiment. A general method 1105 of providing a pump power end with different lubes begins at a step 1109 in which a first lube is identified for use with a gearbox of a pump, e.g., gearbox 1048 of FIGS. 10A-D. A second lube is then identified in a step 1113 for use with a crankcase of the power end of the pump, e.g., crankcase 1002 of power end 1000*a* of FIGS. 10A-D. The first lube and the second lube generally have different characteristics, although it should be appreciated that the first lube and the second lube may instead have substantially the same characteristics.

After the first and second lubes are identified, a seal is provided between the crankcase and the gearbox in a step 1117. By way of example, seal arrangement 1078 may be provided between crankcase 1002 and gearbox 1048 of FIGS. 10A-D.

Once the seal is provided between the crankcase and the gearbox, the second lube is provided to the crankcase in a step 1121. For instance, power end lube manifold inlet 1084*a*, power end lube passthrough 1084*b*, and a hose 1084*c* may cooperate to provide the second lube to crankcase 1002 of power end 1000*a*.

In a step 1125, the first lube is provided to the gearbox. The first lube may be provided by one or more nozzles. Upon providing the first lube to the gearbox, the general method of providing a pump with different lubes is completed.

Although only a few embodiments have been described in this disclosure, it should be understood that the disclosure may be embodied in many other specific forms without departing from the spirit or the scope of the present disclosure. By way of example, while a reciprocating pump such as a frac pump has been described, the use of separate, isolated lubricant or lube systems in a pump is not limited to being implemented with respect to other reciprocating pumps.

In general, a power end that includes multiple isolated lube systems may be used with any suitable fluid end and/or as part of any suitable pump. That is, multiple isolated lube systems may be incorporated into substantially any pump which utilizes a power end.

While the embodiments have been illustrated and described in detail, the disclosure is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. Accordingly, it is appropriate that the appended claims be construed broadly, and in a manner consistent with the scope of the disclosure as set forth in the following claims.

Similarly, it is intended that the present invention covers the modifications and variations of this invention that come within the scope of the appended claims and their equivalents. For example, it is to be understood that terms such as "first," "second," "Nth," and the like as may be used herein merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A power end of a high pressure reciprocating pump, comprising:

a first area, the first area including at least a first component;

a second area, the second area including at least a second component, wherein the first area and the second area are separated by a seal arrangement;

a first lube arrangement, the first lube arrangement being configured to provide a first lube to the first area, wherein the first lube has a first viscosity; and a second lube arrangement, the second lube arrangement being configured to provide a second lube to the second area, wherein the second lube has a second viscosity, the first viscosity being higher than the second viscosity.

2. The power end of the high pressure reciprocating pump of claim 1, wherein the power end includes a gearbox and a crankcase, the first area is in the gearbox, and the second area is in the crankcase.

3. The power end of the high pressure reciprocating pump of claim 2 wherein the second component is a crankshaft.

4. The power end of the high pressure reciprocating pump of claim 3 wherein the second area further includes at least one connecting rod.

5. The power end of the high pressure reciprocating pump of claim 1 wherein the first lube arrangement and the first area form a first lube system, and wherein the second lube arrangement and the second lube area form a second lube system, the first lube system being isolated from the second lube system.

6. The power end of the high pressure reciprocating pump of claim 5 further including:

a first drain arrangement, wherein the first drain arrangement is included in the first lube system, wherein the first drain arrangement is configured to drain the first lube.

7. A power end of the high pressure reciprocating pump, of comprising:

a first area, the first area including at least a first component;

a second area, the second area including at least a second component, wherein the first area and the second area are separated by a seal arrangement;

a first lube arrangement, the first lube arrangement being configured to provide a first lube to the first area from a first lube source and a first lube pump; and a second lube arrangement, the second lube arrangement being configured to provide a second lube to the second area from a second lube source and a second lube pump.

8. The power end of the high pressure reciprocating pump of claim 7, wherein the power end includes a gearbox and a crankcase, the first area is in the gearbox, and the second area is in the crankcase.

9. The power end of the high pressure reciprocating pump of claim 7, wherein the first lube arrangement and the first area form a first lube system, and wherein the second lube arrangement and the second lube area form a second lube system, the first lube system being isolated from the second lube system.

10. A high pressure reciprocating pump, comprising:

a fluid end; and a power end coupled to the fluid end and configured to provide pumping power to the fluid end, wherein the power end includes a plurality of independent lube systems including a first lube system and a second lube system, the first lube system providing lube to a first area and the second lube system providing lube to a second area, the first lube system including a first lube contained in the first area and the second lube system including a second lube contained in the second area, separate from the first area, wherein the first lube has a first viscosity, and the second lube has a second viscosity, the first viscosity being higher than the second viscosity.

11. The high pressure reciprocating pump of claim 10 wherein the first area includes at least a portion of a power train, and the second area includes at least a portion of a crankcase, and wherein the second area includes a crankshaft.

12. The high pressure reciprocating pump of claim 11 wherein the second area further includes at least one connecting rod.

13. The high pressure reciprocating pump of claim 10 wherein the first area is separated from the second area by a seal.

14. The high pressure reciprocating pump of claim 10 wherein the power end comprises a gearbox and a crankcase, the first area being defined in the gearbox and the second area being defined in the crankcase.

15. An assembly for use with a pump, comprising:

a first lube system, the first lube system including a first area and a first lube pump arranged to pump a first lube into the first area, wherein the first lube has a first viscosity; and a second lube system, the second lube system including a second area and a second lube pump arranged to pump a second lube into the second area; the second lube system being isolated from the first lube system, wherein, the second lube has a second viscosity, the first viscosity being higher than the second viscosity, wherein the first lube has at least one additional characteristic that differs from the second lube.

16. The assembly of claim 15 wherein the second area includes a crankshaft and at least one connecting rod.

17. The assembly of claim 16 wherein the first area includes a planetary dam of a planetary carrier.

18. The assembly of claim 15 wherein the first lube includes at least one extreme pressure additive.

19. The assembly of claim 15 wherein the pump is a frac pump.

20. The assembly of claim 15 wherein the pump is a high pressure reciprocating including a bull gear and pinion style power end that is operatively connected to a fluid end.

* * * * *